US005682910A

United States Patent [19]

Kizawa et al.

[11] Patent Number: 5,682,910

[45] Date of Patent: Nov. 4, 1997

[54] COSMETIC CASE WITH PUSH BUTTON DEFINED AND SURROUNDED BY AN ELASTICALLY DEFORMABLE ANNULAR GROOVE

[75] Inventors: Ichiro Kizawa, Tokyo; Yukitomo Yuhara, Abiko, both of Japan

[73] Assignee: Yoshida Industry Co., Ltd., Tokyo, Japan

[21] Appl. No.: 726,203

[22] Filed: Oct. 4, 1996

[30] Foreign Application Priority Data

Nov. 1, 1995 [JP] Japan ..... 7-284748

[51] Int. Cl.[6] ..... A45D 33/00

[52] U.S. Cl. ..... 132/293; 220/326; 292/254; 206/823

[58] Field of Search ..... 132/293, 294, 132/295, 296, 297, 298, 299, 300, 301, 315; 220/326, 324, 4.22, 4.23, 4.24, 4.25; 292/83, 254, DIG. 37, 307 B; 206/823, 581

[56] References Cited

FOREIGN PATENT DOCUMENTS 62-21204 5/1987 Japan .

*Primary Examiner*—Todd E. Manahan
*Assistant Examiner*—E. Robert
*Attorney, Agent, or Firm*—Wenderoth, Lind & Ponack

[57] ABSTRACT

A case body has a surrounding peripheral wall including a thicker front wall portion which has a hole defined centrally therein which opens forwardly and upwardly. A first hook projects from a vertical rear inner wall of the hole, and a second hook projects from a front end lower surface of a lid in positionally corresponding relation to the first hook. The first and second hooks are engageable with each other in a region that is covered with a cover which is snugly fitted in a recess defined in a front surface of the thicker front wall portion in communication with the hole. The cover is made of a thermoplastic elastomer and has a push button formed as a central thinner region. A hook disengaging pin projects inwardly from an inner surface of the push button into the hole. The push button is defined and surrounded by an annular groove extending circularly around the push button.

10 Claims, 10 Drawing Sheets

COSMETIC CASE WITH PUSH BUTTON DEFINED AND SURROUNDED BY AN ELASTICALLY DEFORMABLE ANNULAR GROOVE

BACKGROUND OF THE INVENTION

1. Field of the Invention

The present invention relates to a cosmetic case for containing a cosmetic material therein, and more particularly to a portable cosmetic case which can be carried around by the user.

2. Description of the Prior Art

Generally, a small cosmetic case known as a compact is used to carry around a cosmetic material. Such a small cosmetic case has a case body for containing the cosmetic material. The cosmetic case also has a lid openably and closably hinged to a rear end of the case body. The lid is usually kept in a closed state by mutual engagement of hooks mounted respectively on front ends of the lid and the case body. The lid can be opened when the hooks are disengaged from each other by pushing a push button that projects from the front end of the case body.

Japanese Utility-model Publication No. 62-21204 discloses a cosmetic case having a lid opening mechanism for opening a lid hinged to a case body. Specifically, the mechanism has a pusher disposed in a groove defined in the case body for forcibly pushing upwardly a hook mounted on the lid, and a soft cover disposed in a front inlet of the groove. When the soft cover is pushed, it causes the pusher to push the hook for thereby opening the lid.

According to the disclosed lid opening mechanism, since the pusher is independently positioned in the groove, the number of parts of the lid opening mechanism is large, and the process of assembling the lid opening mechanism is complex. The soft cover is so thick that the user is required to apply large pushing forces to move the pusher through the soft cover. Consequently, the lid cannot be opened easily and smoothly.

SUMMARY OF THE INVENTION

It is therefore an object of the present invention to provide a cosmetic case which is made up of a reduced number of parts and has good release operation that a lid can be opened easily and smoothly.

To achieve the above object, there is provided in accordance with the present invention a cosmetic case comprising a case body for storing a cosmetic material therein, the case body having a first hook, a lid openably and closably mounted on the case body, the lid having a second hook, the first hook and the second hook being engageable with each other in a region to keep the lid closed on the case body, a soft cover positioned outwardly of the region and covering the region, the soft cover having a push button defined and surrounded by an elastically deformable annular groove defined in the soft cover, and a hook disengaging pin provided on the push button for disengaging the first hook and the second hook from each other.

When the push button is pushed, the hook disengaging pin is pushed in thereby to disengage the first and second hooks from each other, opening the lid. Since the push button on the soft cover defined and surrounded by the elastically deformable annular groove, the flexibility of the soft cover and the elastic deformability of the annular groove allow the push button, when pushed, to flex to a large distance while exerting substantially small reactive repelling forces. The push button can thus be pushed in a sufficient distance under substantially small manual pushing forces. As a result, the push button can be pushed easily and smoothly, allowing the release of the second hook from the first hook easily and smoothly. Because the push button is defined and surrounded by the elastically deformable annular groove, the position of the push button can be visually recognized with ease. This permits the partly spherical push button to project slightly, and hence allows the push button to be relatively flat on the outer surface of the case body. The hook disengaging pin may be combined with the push button before the cosmetic case is assembled. Therefore, the number of parts of the cosmetic case at the time it is assembled is reduced, and the cosmetic case can be assembled easily and efficiently.

The case body may have a recess defined in a peripheral wall thereof in communication with the region, and the soft cover may be hermetically fitted in the recess.

Alternatively, the lid may have a recess defined in a peripheral wall thereof in communication with the region, and the soft cover may be hermetically fitted in the recess.

The cover may be made of either a pliable rubber-like thermoplastic elastomer selected from the group consisting of elastomers of polyolefin, styrene, polyester, polyurethane, and vinyl chloride, or a pliable soft synthetic resin.

The cover may be fused to and integrally formed with the case body or the lid by a two-component molding process.

The cover may have a thinner central region and a thicker region extending around the thinner central region, and the push button may comprise the thinner central region and have a partly spherical outer surface projecting slightly outwardly beyond a flat outer surface of the thicker region, the thicker region having an engaging member for retaining the cover on the case body or the lid.

The annular groove may be defined by an elastically deformable thin wall extending around the push button.

The hook disengaging pin may be formed integrally with an inner surface of the push button.

Alternatively, the hook disengaging pin may be formed of a hard synthetic resin separately from the cover, and is combined with the push button.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
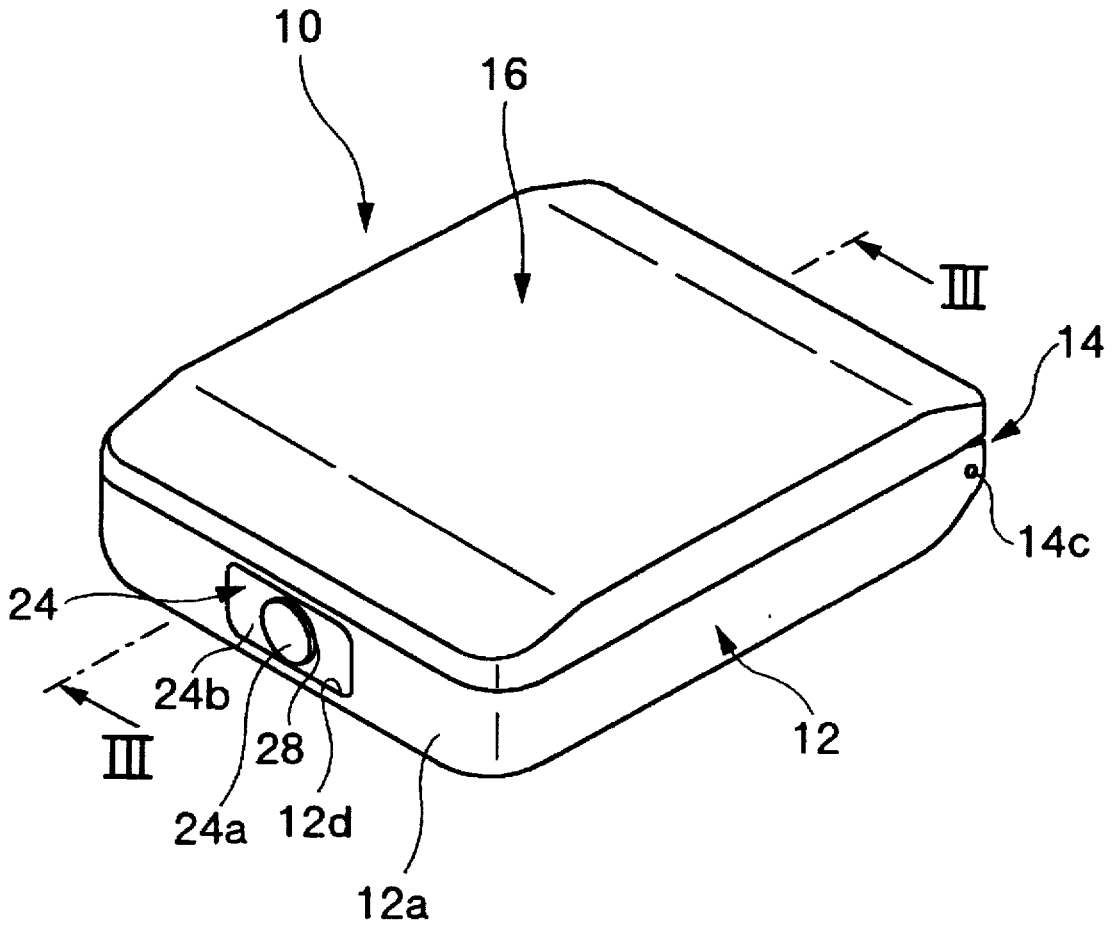
FIG. 1 is a perspective view of a cosmetic case, with a lid closed, according to a first embodiment of the present invention.

Like or corresponding parts are denoted by like or corresponding reference numerals throughout views.

Figure 2:
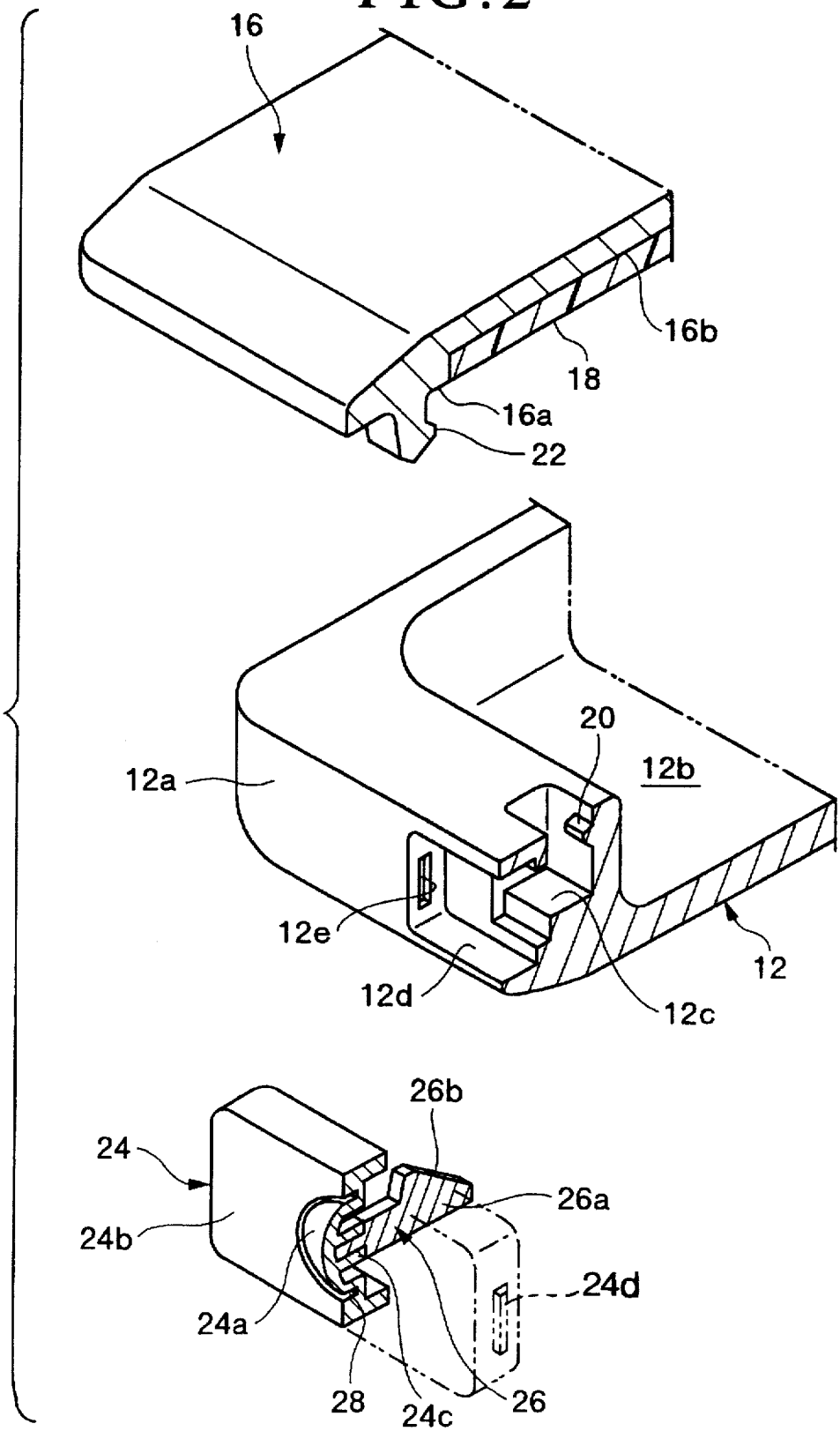
FIG. 2 is an enlarged fragmentary exploded perspective view of the cosmetic case shown in FIG. 1.

FIGS. 1 through 4 show a cosmetic case according to a first embodiment of the present invention. As shown in FIGS. 1 and 2, the cosmetic case, generally designated by the reference numeral 10, comprises a case body 12 for containing a cosmetic material therein and a lid 16 openably and closably mounted on the case body 12. The lid 16 is usually kept in a closed state by mutual engagement of a first hook 20 of the case body 12 and a second hook 22 of the lid 16. A region where the first and second hooks 20, 22 engage each other is covered with a soft cover 24 positioned outwardly of the region. The soft cover 24 has a push button 24a defined and surrounded by an elastically deformable annular groove 28 which is defined in the soft cover 24. A hook disengaging pin 26 for disengaging the first and second hooks 20, 22 from each other projects inwardly from the push button 24a.

Figure 3:
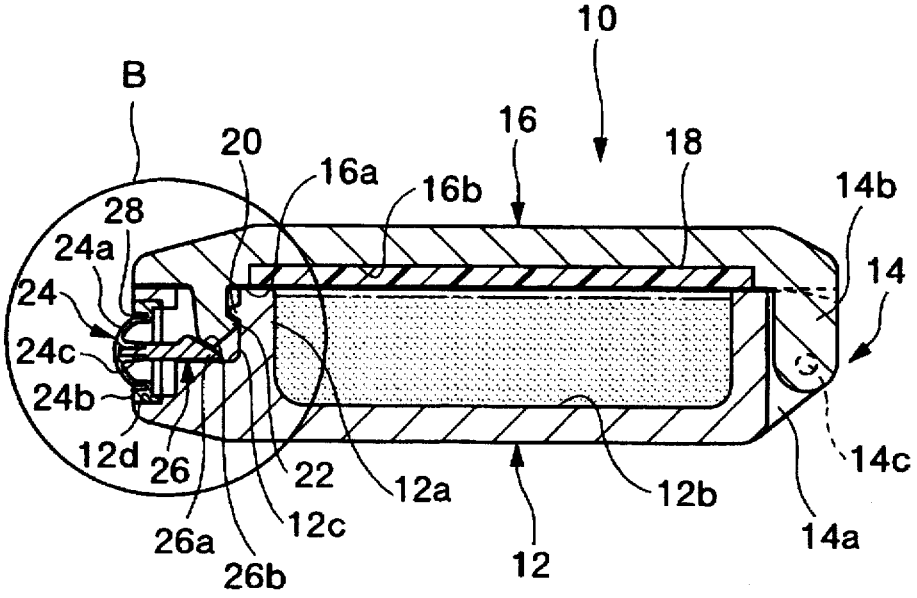
FIG. 3 is a cross-sectional view taken along line (A)—(A) of FIG. 1.

As shown in FIGS. 1 and 3, the lid 16 is attached to a rear end of the case body 12 by a hinge 14. The case body 12 has a storage cavity 12b defined therein by a surrounding peripheral wall 12a thereof for storing a cosmetic material. The hinge 14 comprises a recess 14a defined centrally in the rear end of the case body 12, an arm 14b disposed centrally on a rear end of the lid 16, and a pair of hinge pins 14c inserted through the rear end of the case body 12 into opposite sides of the arm 14b in the recess 14a. The lid 16 has a concave 16b defined in a lower surface 16a thereof, and a vanity mirror 18 is fitted in the recess 16b.

The right-hand side of the cosmetic case 10 as shown in FIG. 3, on which the hinge 14 is mounted, is referred to as a rear side, and the left-hand side thereof, which is opposite to the right-hand side thereof, is referred to as a front side where the soft cover 24 is positioned.

As shown in FIG. 2, the peripheral wall 12a includes a thicker front wall portion having a hole 12c defined centrally therein which opens forwardly and upwardly. The first hook 20 projects from a vertical rear inner wall of the hole 12c, and the second hook 22 projects from a front end lower surface 16a of the lid 16 in positionally corresponding relation to the first hook 20. When the first and second hooks 20, 22 engage each other, the lid 16 remains closed.

The thicker front wall portion also has a recess 12d defined in a front end thereof in communication with the hole 12c and having a width greater than the hole 12c. The cover 24 is snugly and hermetically fitted in the recess 12d. The cover 24 is made of a soft thermoplastic elastomer. The push button 24a is formed as a thinner region in the central area of the cover 24 and surrounded by a thicker region 24b of the cover 24 with the annular groove 28 interposed therebetween. The thermoplastic elastomer has been developed as a material from which a rubber-like elastometric product can be molded by a plastic molding machine. Various elastomers known at present include elastomers of polyolefin, styrene, polyester, polyurethane, vinyl chloride, etc.

The thicker region 24b is of a rectangular shape complementary to the recess 12d. The thicker region 24b has a pair of teeth 24d projecting from respective opposite sides thereof and fitted in respective slots 12e defined in respective opposite side walls of the recess 12d. Therefore, the cover 24 is retained in the recess 12d against dislodgment.

The push button 24a has a partly spherical outer surface projecting slightly outwardly beyond a flat outer surface of the thicker region 24b. The hook disengaging pin 26 projects inwardly from an inner surface of the push button 24a into the hole 12c. The hook disengaging pin 26 includes a tip end 26a having an upper slanted surface 26b which is inclined progressively downwardly in the rearward direction away from the push button 24a.

When the lid 16 is closed, the slanted surface 26b abuts against a lower surface of the second hook 22 (see FIG. 3). The hole 12c has a lower horizontal surface extending in the direction in which pushing forces are exerted from the push button 24a. The hook disengaging pin 26 has a lower surface slidably held against the lower horizontal surface of the hole 12c. The hook disengaging pin 26 is made of a hard synthetic resin separately from the cover 24 and the push button 24a, and has a front end, remote from the tip end 26a, press-fitted in a tubular support 24c that projects rearwardly from the inner surface of the push button 24a.

The elastically deformable annular groove 28 is defined around the push button 24a. The annular groove 28 extends circularly around the push button 24a adjacent to the thicker region 24b. The annular groove 28 is defined by an elastically deformable thin wall having a thickness ranging from 0.2 mm to 1.0 mm, and has a predetermined depth.

Figure 4:
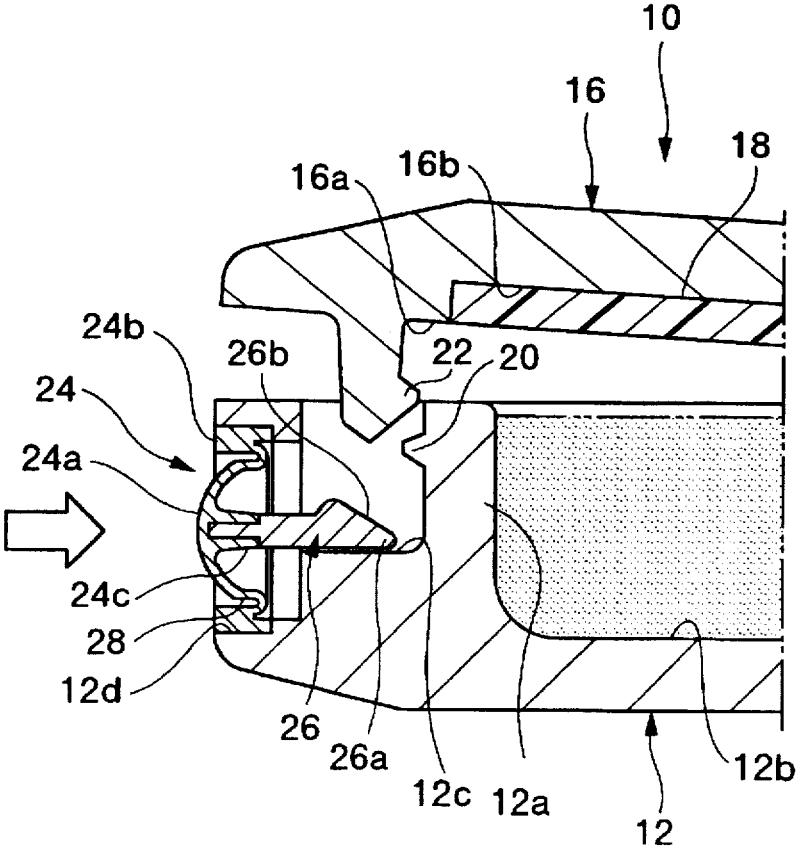
FIG. 4 is an enlarged cross-sectional view of an encircled portion (B) of the cosmetic case shown in FIG. 3, showing the manner in which a lid is opened.

The lid 16 is usually closed by the first and second hooks 20, 22 that engage each other, as shown in FIG. 3. When the push button 24a is not pushed, but is in its free state, the push button 24a projects outwardly, retracting the hook disengaging pin 26 forwardly, i.e., leftwardly in FIG. 3. When the push button 24a is manually pushed, as shown in FIG. 4, in order to open the lid 16, the push button 24a is elastically deformed, pushing the hook disengaging pin 26 rearwardly, i.e., rightwardly in FIG. 4. The second hook 22 which is held against the slanted surface 26b of the tip end 26a is forcibly pushed upwardly by the rearward movement of the hook disengaging pin 26, and then rides over and is released from the first hook 20.

When the second hook 22 is thus disengaged from the first hook 20, the lid 16 is slightly turned upwardly away from the case body 12, i.e., slightly opened, as shown in FIG. 4. Subsequently, the lid 16 can manually be opened widely away from the case body 12. When the push button 24*a* is released from the manual push, the hook disengaging pin 26 returns back forwardly under the resiliency of the push button 24*a* surrounded by the annular groove 28.

For closing the lid 16 which has been opened, the lid 16 is simply manually pushed toward the case body 12 until the second hook 22 is downwardly inserted into the hole 12*c* and snaps into engagement with the first hook 20. When the second hook 22 is engaged by the first hook 20, the lower surface of the second hook 22 is held against the slanted surface 26*b* of the hook disengaging pin 26.

As described above, the cover 24 is made of a thermoplastic elastomer which is a soft rubber-like material. Therefore, the cover 24 is elastically pliable itself, allowing the push button 24*a* to be elastically deformable. Inasmuch as the push button 24*a* is defined and surrounded by the elastically deformable annular groove 28 in addition to the fact that the cover 24 is elastically pliable, the push button 24*a*, when pushed, flexes to a large distance, but exerts substantially small reactive repelling forces. The push button 24*a* can thus be pushed in a sufficient distance under substantially small manual pushing forces. As a result, the push button 24*a* can be pushed easily and smoothly, allowing the release of the second hook 22 from the first hook 20 easily and smoothly.

Because the push button 24*a* is defined and surrounded by the elastically deformable annular groove 28, the position of the push button 24*a* can be visually recognized with ease. This permits the partly spherical push button 24*a* to project slightly, and hence allows the push button 24*a* to be relatively flat on the outer surface of the case body 12. The hook disengaging pin 26, which is separate from the cover 24, may be combined with the push button 24*a* before the cosmetic case 10 is assembled. Therefore, the number of parts of the cosmetic case 10 at the time it is assembled is reduced, and the cosmetic case 10 can be assembled easily and efficiently.

The cover 24 is snugly fitted in the recess 12*d* which communicates with the hole 12*c*. The cover 24 thus prevents dust, dirt, or other foreign matter from finding their way through the recess 12*d* and the hole 12*c* into the cosmetic case 10 when the lid 16 is closed. Accordingly, the push button 24*a* is prevented from suffering a malfunction which would otherwise be developed by a deposit of dust, dirt, or other foreign matter in the recess 12*d* and the recess 12*c*, and the cosmetic case 10 is kept clean in its interior space.

Figure 5:
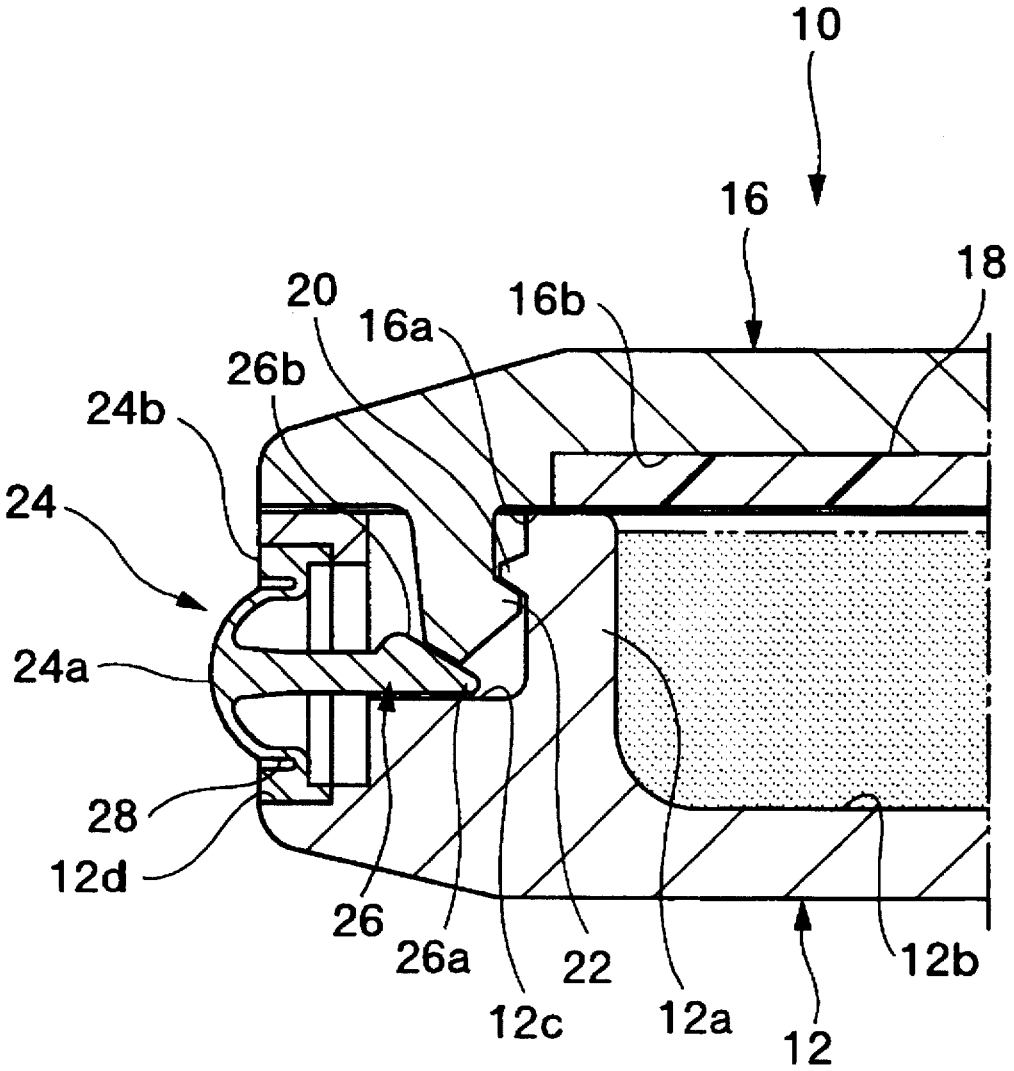
FIG. 5 is an enlarged fragmentary cross-sectional view of a modification of the cosmetic case according to the first embodiment.

FIG. 5 shows a modification of the cosmetic case 10 according to the first embodiment of the present invention. According to the modification shown in FIG. 5, the push button 24*a* and the hook disengaging pin 26 are integrally formed with each other of a thermoplastic elastomer. The hook disengaging pin 26 of a thermoplastic elastomer is constructed to have a predetermined cross-sectional area in order to retain a desired degree of rigidity.

Figure 6:
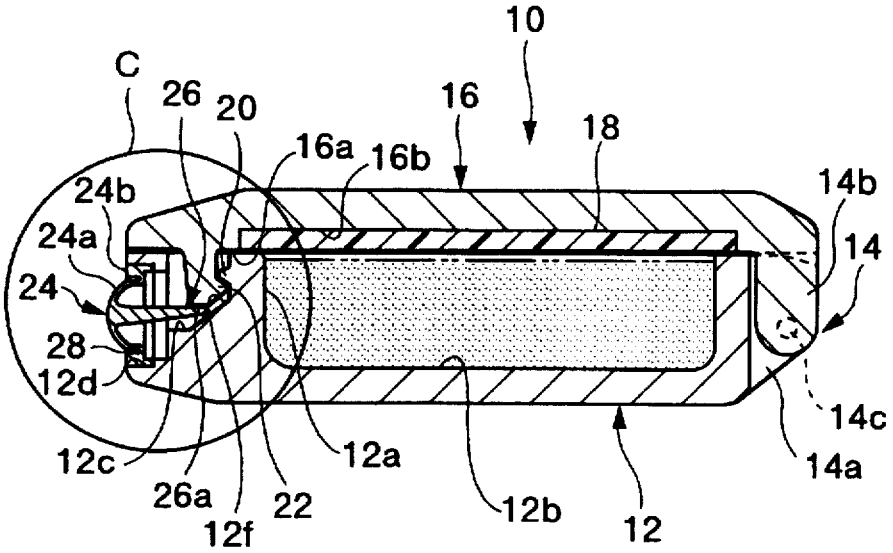
FIG. 6 is a cross-sectional view, similar to FIG. 3, of a cosmetic case according to a second embodiment of the present invention.
Figure 7:
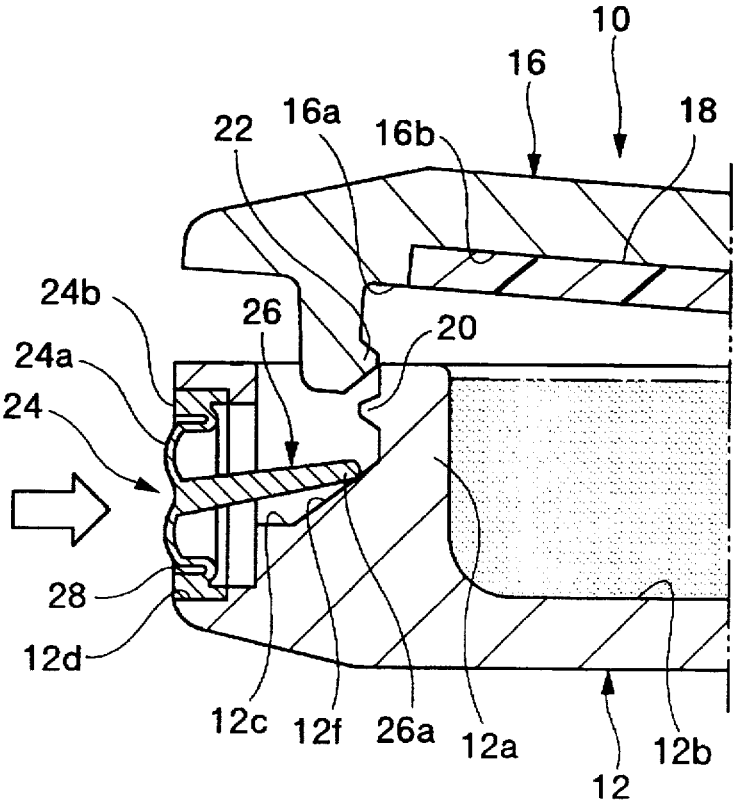
FIG. 7 is an enlarged cross-sectional view of an encircled portion (C) of the cosmetic case shown in FIG. 6, showing the manner in which a lid is opened.

FIGS. 6 and 7 show a cosmetic case according to a second embodiment of the present invention. Those parts shown in FIGS. 6 and 7 which are identical to those shown in FIGS. 1 through 5 are denoted by identical reference numerals, and will not be described in detail below.

As shown in FIG. 6, the hook disengaging pin 26 which integrally projects inwardly from the push button 24*a* of the cover 24 is of a columnar shape, and the lower surface of the hole 12*c* includes a slanted surface 12*f* which is inclined progressively upwardly in the rearward direction away from the push button 24*a*. When the lid 16 is closed, the tip end 26*a* of the hook disengaging pin 26 abuts against the lower surface of the second hook 22, and a lower surface of the tip end 26*a* is held against the slanted surface 12*f*.

When the push button 24*a* is pushed in order to open the lid 16, the hook disengaging pin 26 is pushed in, causing the tip end 26*a* to be lifted up the slanted surface 12*f*, as shown in FIG. 7. The second hook 22 which is held against an upper surface of the tip end 26*a* is forcibly elevated by the tip end 26*a* thus lifted until the second hook 22 rides over and is disengaged from the first hook 20, whereupon the lid 16 is opened.

While the hook disengaging pin 26 is shown as being integral with the push button 24*a* in the second embodiment, the hook disengaging pin 26 may be formed separate from the push button 24*a*.

Figure 8:
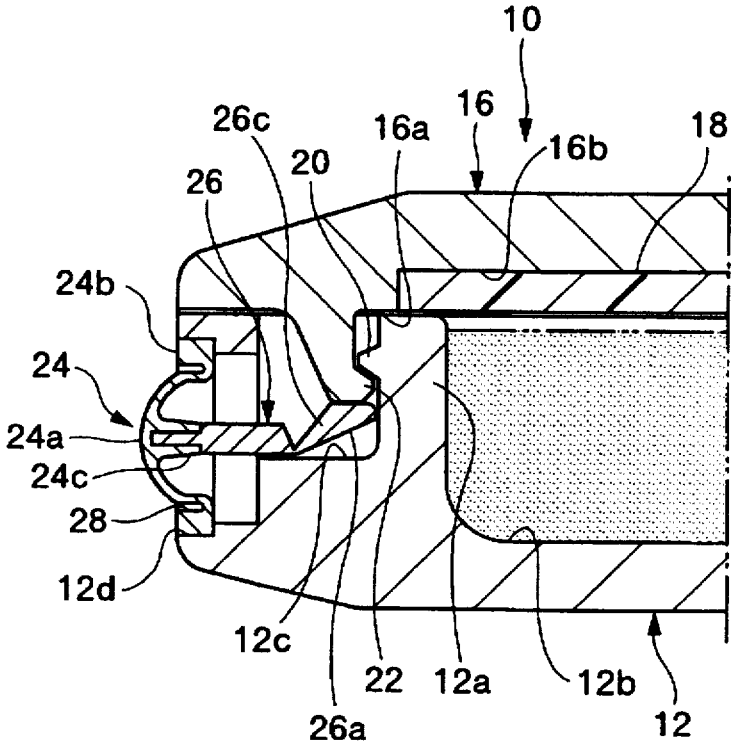
FIG. 8 is an enlarged fragmentary cross-sectional view of a cosmetic case according to a third embodiment of the present invention.
Figure 9:
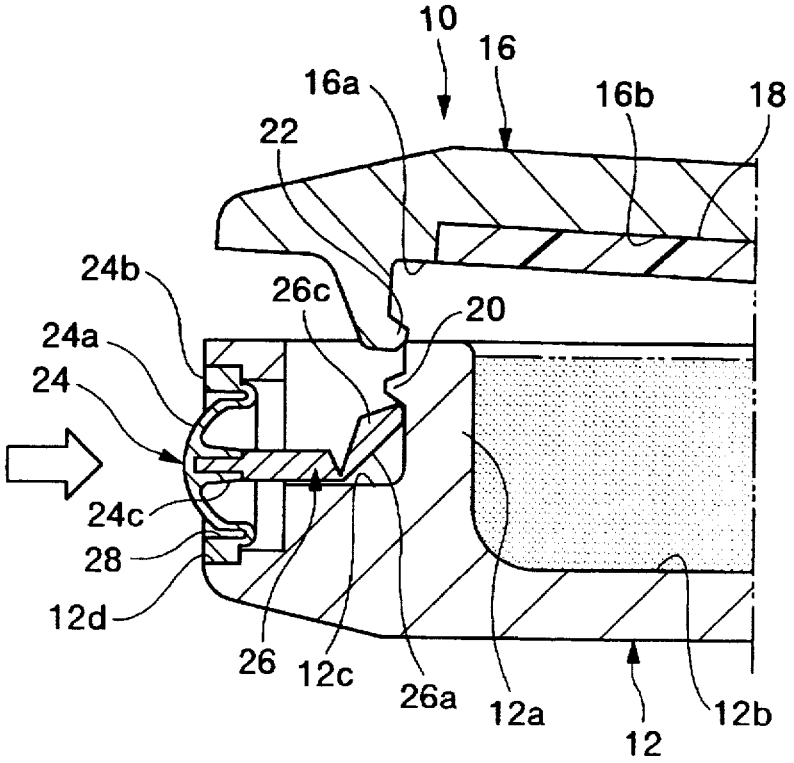
FIG. 9 is an enlarged fragmentary cross-sectional view of the cosmetic case shown in FIG. 8, showing the manner in which a lid is opened.

FIGS. 8 and 9 show a cosmetic case according to a third embodiment of the present invention. Those parts shown in FIGS. 8 and 9 which are identical to those shown in FIGS. 1 through 7 are denoted by identical reference numerals, and will not be described in detail below.

As shown in FIG. 8, the tip end 26*a* of the hook disengaging pin 26 comprises a substantially triangular elastically bendable member 26*c* whose upper surface is usually held against the lower surface of the second hook 22 when the lid 16 is closed. The distal end of the elastically bendable member 26*c* abuts against the vertical rear inner surface of the hole 12*c* which serves as a guide surface for guiding vertical movement of the bendable member 26*c*.

When the push button 24*a* is pushed to push in the hook disengaging pin 26 for opening the lid 16, the elastically bendable member 26*c* rises along the vertical rear inner surface of the hole 12*c*, as shown in FIG. 9. The elastically bendable member 26*c* forcibly lifts the second hook 22 until the second hook 22 is released from the first hook 20.

Figure 10:
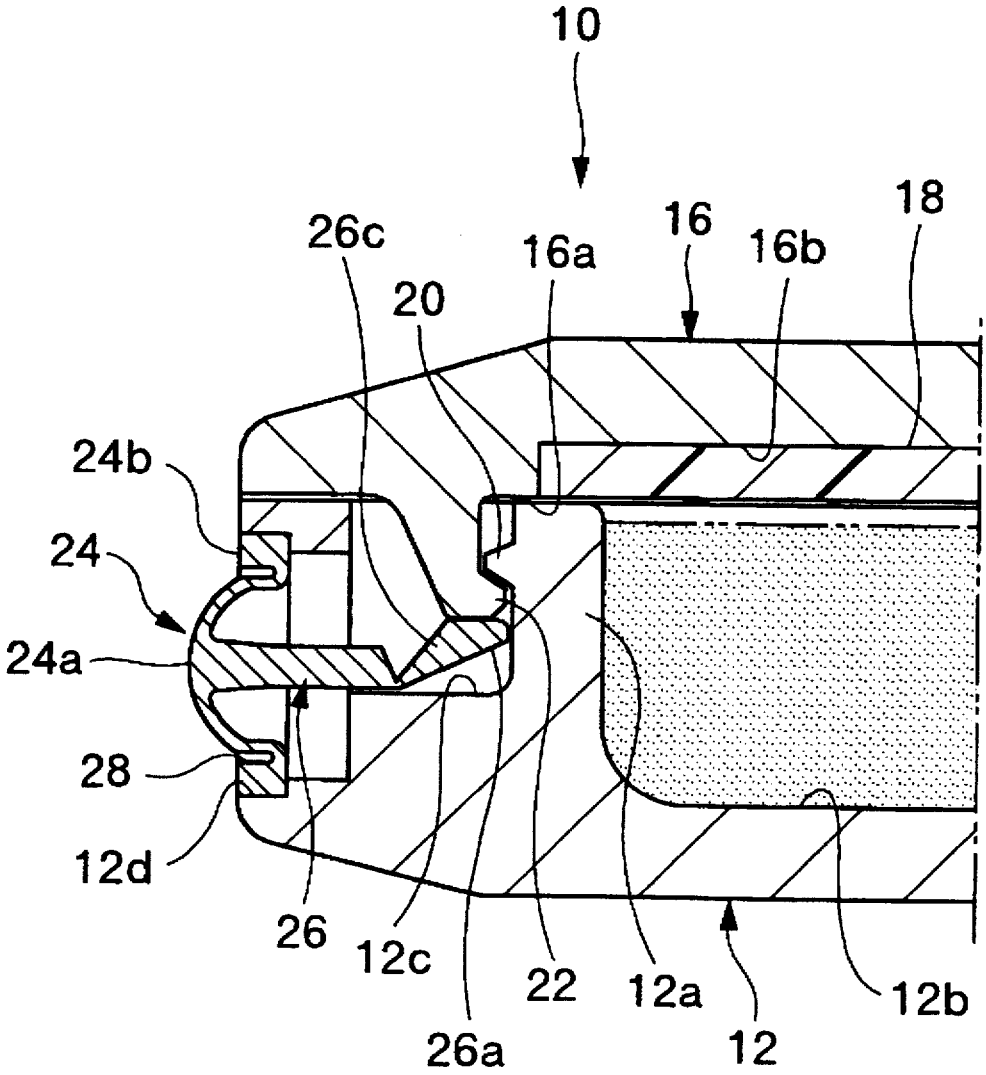
FIG. 10 is an enlarged fragmentary cross-sectional view of a modification of the cosmetic case according to the third embodiment.

In FIGS. 8 and 9, the hook disengaging pin 26 is separate from the push button 24*a*. FIG. 10 shows a modification of the cosmetic case 10 according to the third embodiment. According to the modification shown in FIG. 10, the hook disengaging pin 26 is integrally formed with the push button 24*a*.

Figure 11:
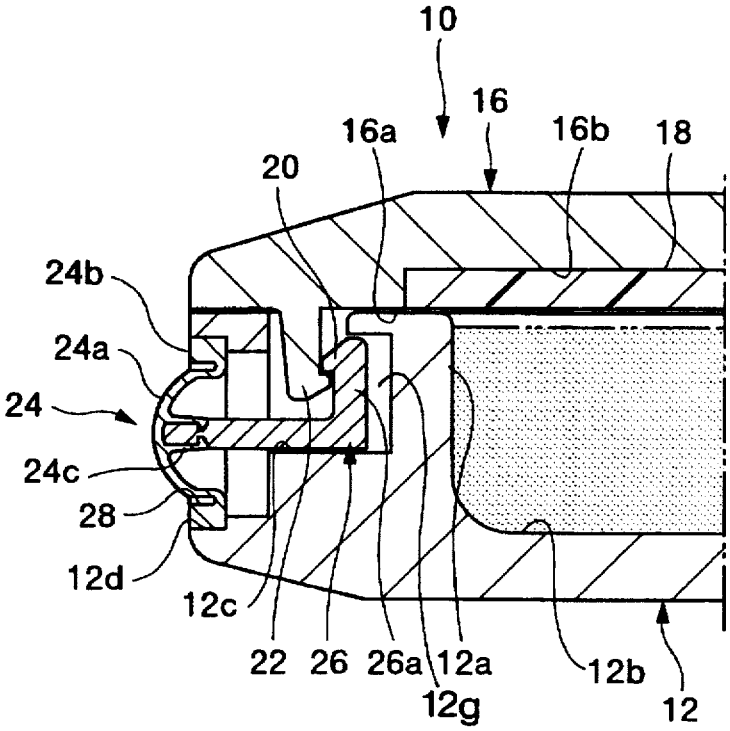
FIG. 11 is an enlarged fragmentary cross-sectional view of a cosmetic case according to a fourth embodiment of the present invention.
Figure 12:
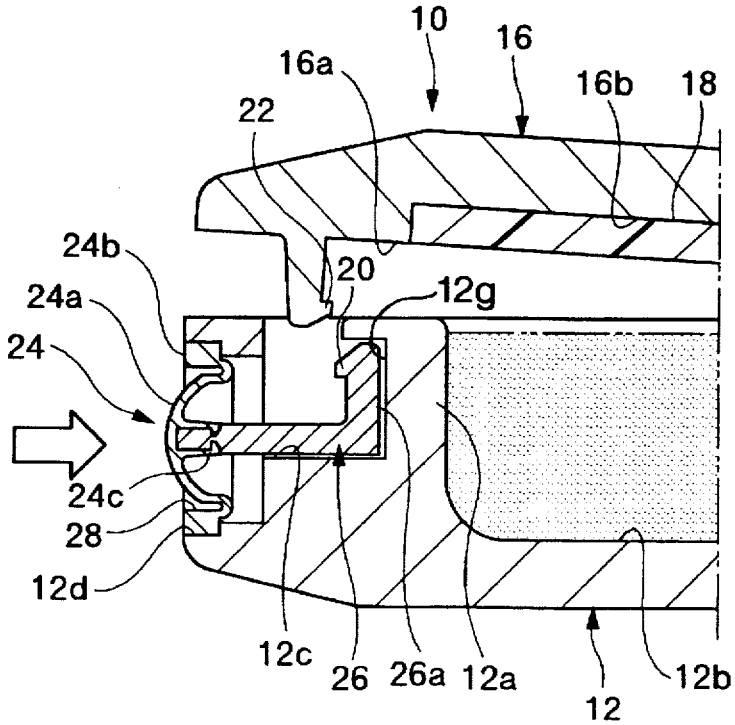
FIG. 12 is an enlarged fragmentary cross-sectional view of the cosmetic case shown in FIG. 11, showing the manner in which a lid is opened.

FIGS. 11 and 12 show a cosmetic case according to a fourth embodiment of the present invention. Those parts shown in FIGS. 11 and 12 which are identical to those shown in FIGS. 1 through 10 are denoted by identical reference numerals, and will not be described in detail below.

As shown in FIG. 11, the hook disengaging pin 26 of an L shape with the tip end 26*a* bend upwardly, and the first hook 20 is formed on the distal end of the tip end 26*a*. The second hook 22 can be disengaged from the first hook 20 when the hook disengaging pin 26 moves rearwardly away from the cover 24. The tip end 26*a* is slidably fitted in a cavity 12*g* defined in the vertical rear inner surface of the hole 12*c*, and hence is retained in the cavity 12*g* against upward movement.

Figure 13:
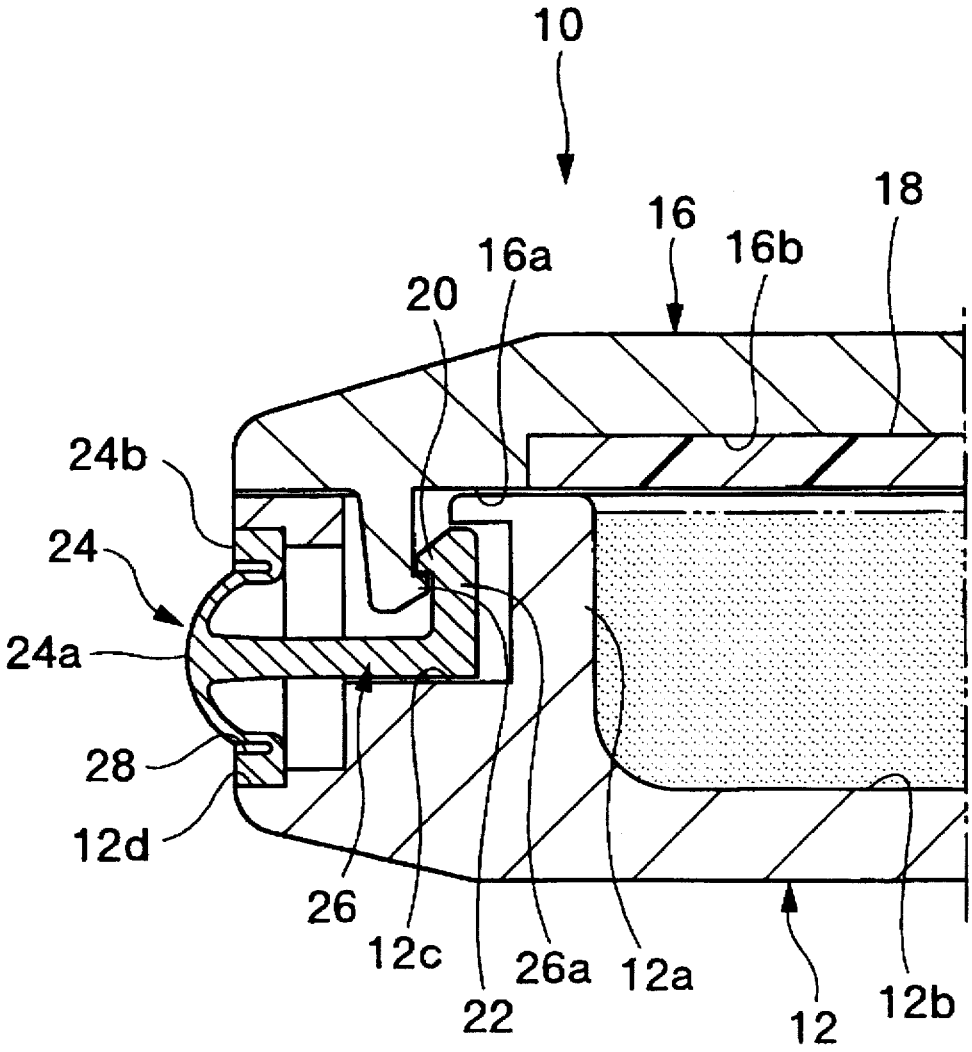
FIG. 13 is an enlarged fragmentary cross-sectional view of a modification of the cosmetic case according to the fourth embodiment.

In FIGS. 11 and 12, the hook disengaging pin 26 is separate from the push button 24*a*. FIG. 13 shows a modification of the cosmetic case 10 according to the fourth embodiment. According to the modification shown in FIG. 13, the hook disengaging pin 26 is integrally formed with the push button 24*a*.

Figure 14:
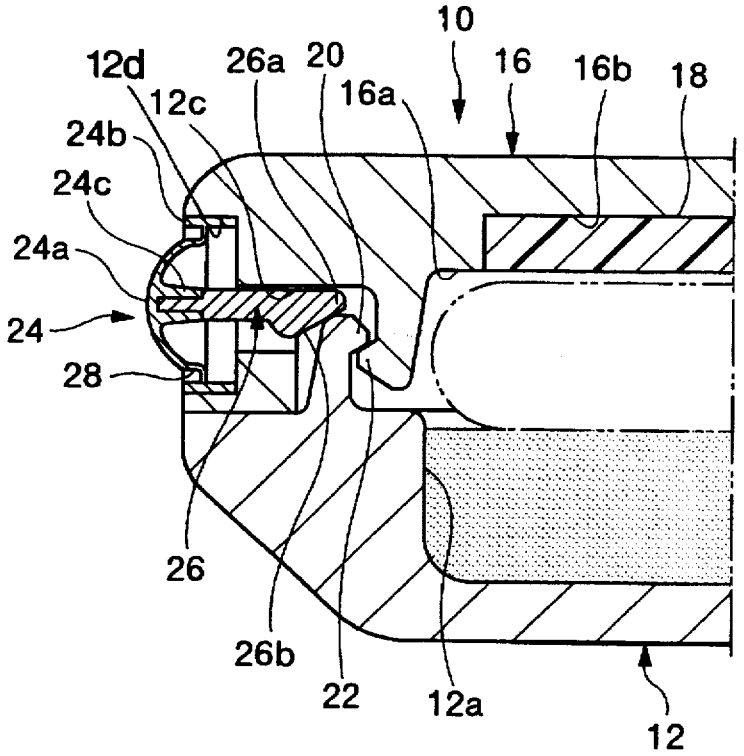
FIG. 14 is an enlarged fragmentary cross-sectional view of a cosmetic case according to a fifth embodiment of the present invention.
Figure 15:
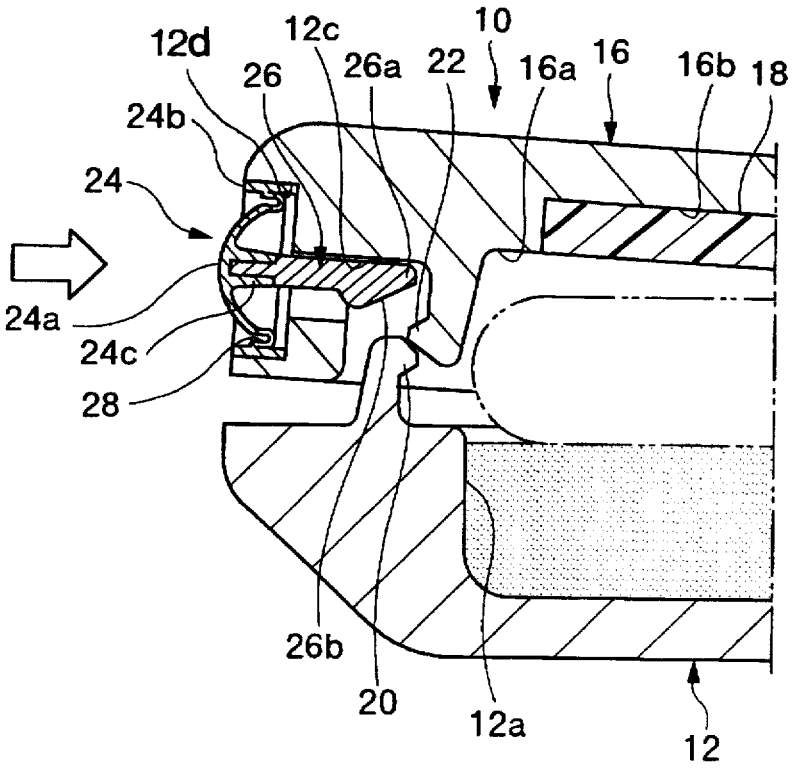
FIG. 15 is an enlarged fragmentary cross-sectional view of the cosmetic case shown in FIG. 14, showing the manner in which a lid is opened.

FIGS. 14 and 15 show a cosmetic case according to a fifth embodiment of the present invention. Those parts shown in FIGS. 14 and 15 which are identical to those shown in FIGS. 1 through 13 are denoted by identical reference numerals, and will not be described in detail below.

As shown in FIG. 14, the cover 24 is mounted on the lid 16, and the hook disengaging structure according to the first embodiment is employed to disengage the first and second hooks 20, 22 from each other. Specifically, the first hook 20 is formed on the case body 12, and the second hook 22 is formed on the lid 16. The hole 12*c* in which the first and second hooks 20, 22 engage each other is defined centrally in the front end of the lid 16, and the cover 24 is snugly fitted in the recess 12*d* that is defined in the front end of a peripheral wall of the lid 16 forwardly of the hole 12*c* in communication therewith. The slanted surface 26*b* on the tip end 26*a* of the hook disengaging pin 26 is held in abutment against the upper end of the first hook 20.

When the push button 24*a* is pushed, the hook disengaging pin 26 is pushed in, causing the slanted surface 26*b* to depress the first hook 20 out of engagement with the second hook 22.

While the hook disengaging structure according to the first embodiment is shown as being employed in the cosmetic case 10 according to the fifth embodiment, either one of the hook disengaging structures according to the second through fourth embodiments may instead be incorporated in the cosmetic case 10 according to the fifth embodiment.

In the second through fifth embodiments, the cover 24 is made of a soft thermoplastic elastomer with the elastically deformable annular groove 28 defined around the push button 24*a* for allowing the push button 24*a* to be sufficiently elastically pliable and to be pushed in a sufficiently large distance. However, the cover 24 may not be made of a soft thermoplastic elastomer, but may be made of a soft synthetic resin in the first through fifth embodiments. The cover 24 is shown as being separate from the case body 12 or the lid 16 and fitted in the recess 12*d* in the first through fifth embodiments. However, the cover 24 may be fused to and integrally formed with the case body 12 or the lid 16 by a two-component molding process.

As described above, the region where the first and second hooks engage each other is covered with the soft cover positioned outwardly of the region. The soft cover has the push button defined and surrounded by the elastically deformable annular groove which is defined in the soft cover. The hook disengaging pin for disengaging the first and second hooks from each other projects inwardly from the push button. The flexibility of the soft cover and the elastic deformability of the annular groove allow the push button, when pushed, to flex to a large distance while exerting substantially small reactive repelling forces. The push button can thus be pushed in a sufficient distance under substantially small manual pushing forces. As a result, the push button can be pushed easily and smoothly, allowing the release of the second hook from the first hook easily and smoothly. Because the push button is defined and surrounded by the elastically deformable annular groove, the position of the push button can be visually recognized with ease. This permits the partly spherical push button to project a reduced distance forwardly, and hence allows the push button to be relatively flat on the outer surface of the case body. The hook disengaging pin may be combined with the push button before the cosmetic case is assembled. Therefore, the number of parts of the cosmetic case at the time it is assembled is reduced, and the cosmetic case can be assembled easily and efficiently.

Although certain preferred embodiments of the present invention have been shown and described in detail, it should be understood that various changes and modifications may be made therein without departing from the scope of the appended claims.

What is claimed is:

1. A cosmetic case comprising:

a case body for storing a cosmetic material therein, said case body having a first hook;

a lid openably and closably mounted on said case body, said lid having a second hook;

said first hook and said second hook being engageable with each other in a region to keep said lid closed on said case body;

a soft cover positioned outwardly of said region and covering said region, said soft cover having a push button defined and surrounded by an elastically deformable annular groove defined in said soft cover; and a hook disengaging pin provided on said push button for disengaging said first hook and said second hook from each other.

2. A cosmetic case according to claim 1, wherein said case body has a recess defined in a peripheral wall thereof in communication with said region, said soft cover being hermetically fitted in said recess.

3. A cosmetic case according to claim 1, wherein said lid has a recess defined in a peripheral wall thereof in communication with said region, said soft cover being hermetically fitted in said recess.

4. A cosmetic case according to claim 1, wherein said cover is made of a pliable rubber-like thermoplastic elastomer selected from the group consisting of elastomers of polyolefin, styrene, polyester, polyurethane, and vinyl chloride.

5. A cosmetic case according to claim 1, wherein said cover is made of a pliable soft synthetic resin.

6. A cosmetic case according to claim 1, wherein said cover is fused to and integrally formed with said case body or said lid by a two-component molding process.

7. A cosmetic case according to claim 1, wherein said cover has a thinner central region and a thicker region extending around said thinner central region, said push button comprising said thinner central region and having a partly spherical outer surface projecting slightly outwardly beyond a flat outer surface of said thicker region, said thicker region having an engaging member for retaining said cover on said case body or said lid.

8. A cosmetic case according to claim 1, wherein said annular groove is defined by an elastically deformable thin wall extending around said push button.

9. A cosmetic case according to claim 1, wherein said hook disengaging pin is formed integrally with an inner surface of said push button.

10. A cosmetic case according to claim 1, wherein said hook disengaging pin is formed of a hard synthetic resin separately from said cover, and is combined with said push button.

* * * * *